United States Patent [19]

Peyton

[11] 3,938,847

[45] Feb. 17, 1976

[54] GRIPPER MEANS

[75] Inventor: John J. Peyton, Santa Barbara, Calif.

[73] Assignee: Industrial Automation Corporation, Santa Barbara, Calif.

[22] Filed: Oct. 23, 1973

[21] Appl. No.: 408,922

Related U.S. Application Data

[63] Continuation-in-part of Ser. No. 305,709, Nov. 13, 1972, abandoned.

[52] U.S. Cl. ..... 294/110 R; 198/179; 214/1 BA; 214/309; 294/87.24

[51] Int. Cl.[2] ..... B66C 1/6.2

[58] Field of Search ..... 294/87.24, 110 R, 87.22; 198/179; 214/309, 1 BA

[56] References Cited

UNITED STATES PATENTS

| | | | |
|---|---|---|---|
| 409,843 | 8/1889 | James | 294/110 R |
| 2,533,230 | 12/1950 | Dixon | 294/110 R X |
| 2,712,405 | 7/1955 | Rockcastle | 294/87.22 X |
| 3,041,102 | 6/1962 | Day | 294/110 A |
| 3,125,369 | 3/1964 | Copping | 294/87.24 |
| 3,174,791 | 3/1965 | Dardaine | 294/87.24 |
| 3,288,513 | 11/1966 | Behrick | 294/110 R X |

*Primary Examiner*—Robert J. Spar
*Assistant Examiner*—George F. Abraham

[57] ABSTRACT

A Full Depth Uncaser for automatically removing bottles from a case having a depth substantially equal to the bottle height, and delivering the bottles to a delivery conveyor. The Uncaser utilizes a system of individual grippers arranged in the general pattern of the bottles in the cases, with the various rows of grippers supported by continuous chains at each side of a gripper assembly. Each individual gripper utilizes an over-center toggle mechanism held to the open position by the toggle, and triggerable by the contact of the center member with the top of a bottle to allow a spring to cause the gripper to close on the neck of the bottle. Bottles are released onto the delivery conveyor by depression of the center member at that point to reset the over-center mechanism. Provisions for synchronizing the cases with the gripper motion as well as other features and improvements for such equipment are disclosed.

12 Claims, 27 Drawing Figures

7
7
104
104
106
108
272
270
100
96
98
6
6
250
99
54
54
54
54
120
120
120
252
100
99
102
94
92
90
260
99
22

Fig. 11
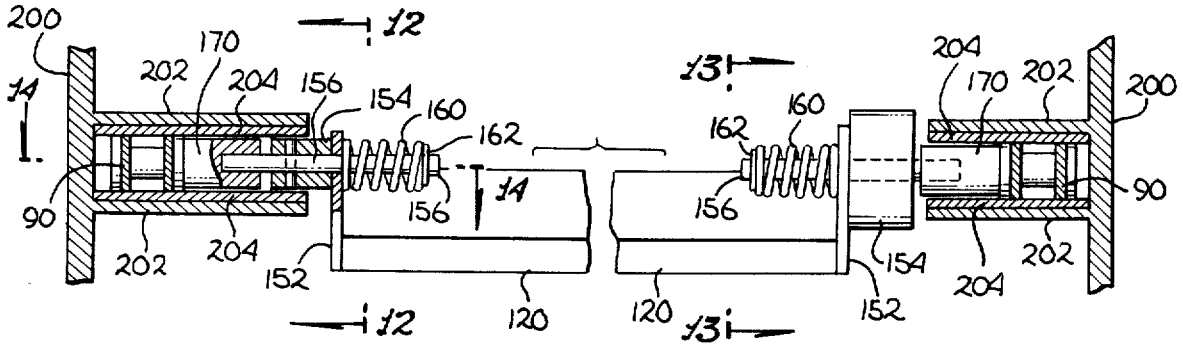
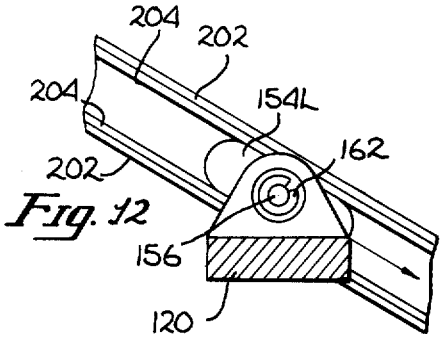
Fig. 12
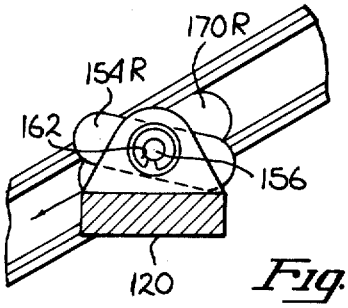
Fig. 13
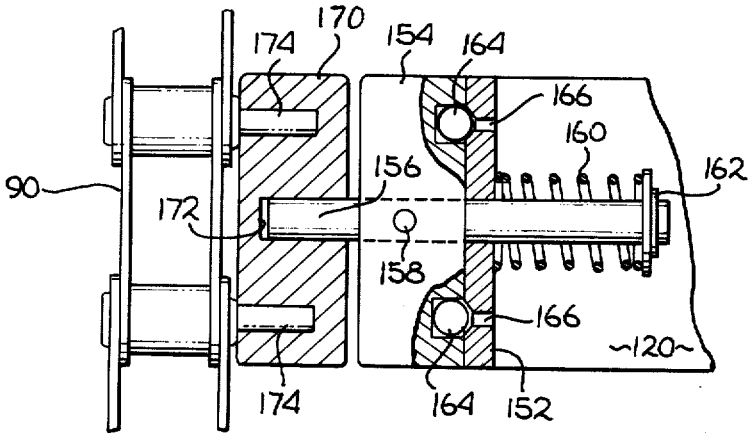
Fig. 14

Fig. 15
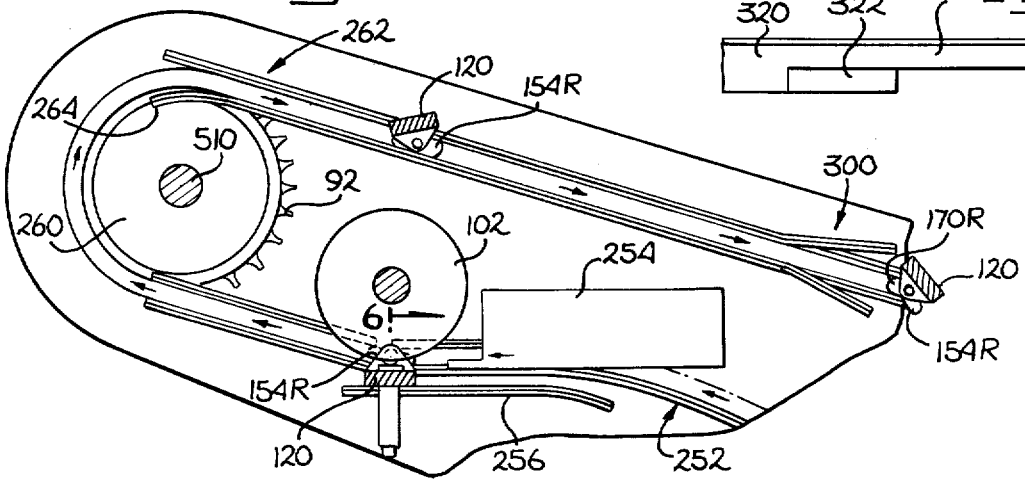
Fig. 18
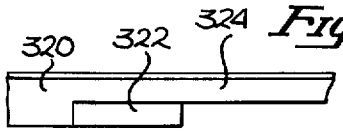
Fig. 16
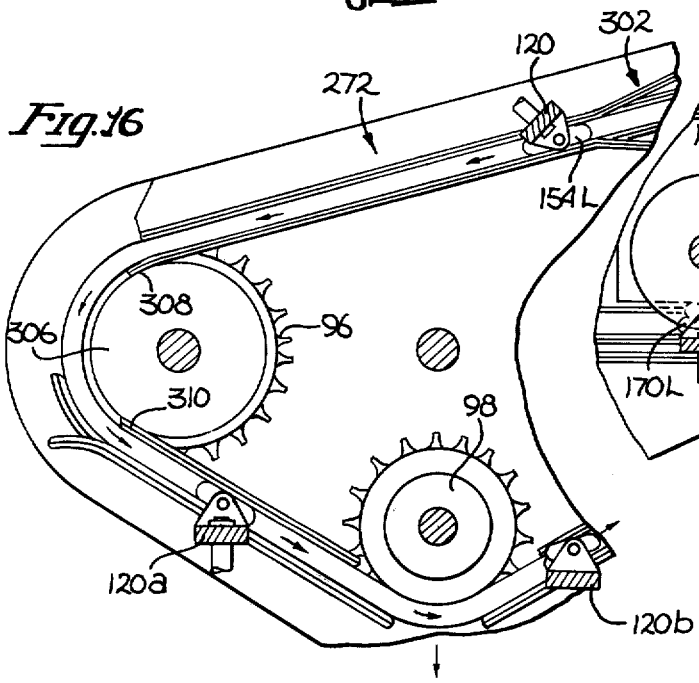
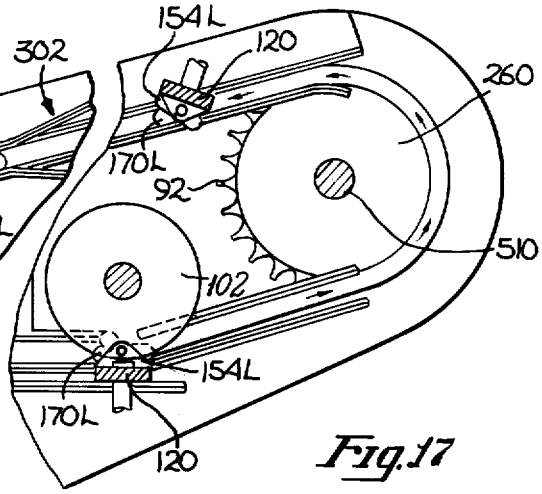
Fig. 17
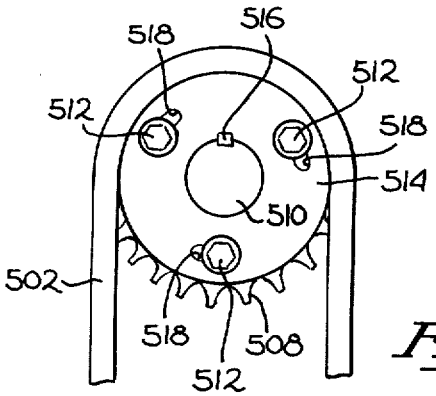
Fig. 19
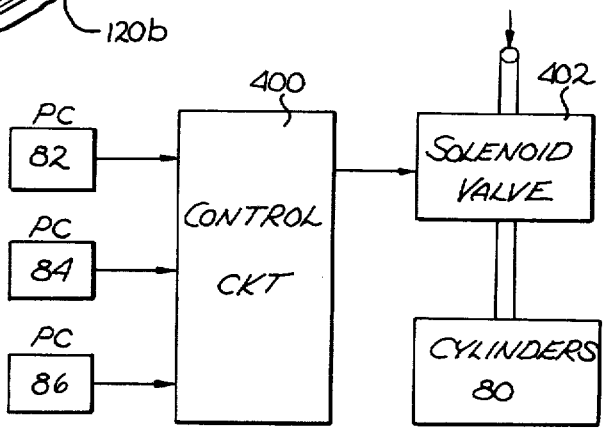
Fig. 20

GRIPPER MEANS

This is a continuation-in-part of application Ser. No. 305,709, filed on Nov. 13, 1972, now abandoned.

BACKGROUND OF THE INVENTION

1. Field of the Invention

The present invention is related to the field of bottle handling apparatus, and more particularly to apparatus for removing bottles from a full depth case and delivering the bottles to a conveyor.

2. Prior Art

Bottle cases, as commonly used for soft drinks and the like, are generally characterized as one of two kinds. The first type of case is referred to as the half depth case, and is characterized by a depth which is only a fraction of the height of the bottles intended to be used in the case. Such cases generally provide for bottle separation and have handles on the ends thereof for lifting, but only extend part way up the bottles and support the lower part of each bottle in the sidewise direction. Thus, in stacking such cases, each case is stacked upon the tops of the bottles on a lower case. In terms of removing bottles from such half depth cases, the neck portion of each of the bottles is available without having to reach over the edge of the case, so that apparatus may be disposed to intercept and grasp the necks of the bottles as the cases pass thereunder. One such type of half depth uncaser is disclosed in U.S. Pat. No. 3,570,693 by John J. Peyton, issued Mar. 16, 1971 and assigned to Industrial Automation Corporation, Santa Barbara, California, the assignee of the present invention.

The second type of bottle case is characterized as having a depth substantially equal to, but generally slightly greater than the height of the bottles to be used therein, so that upon stacking, each case rests upon the top of the lower case, rather than upon the tops of the bottles. To unload bottles from such cases, apparatus must be provided for effectively reaching into the case to grasp the bottles and lift them therefrom. Thus, such apparatus may not be disposed so as to merely intercept the necks of the bottles, as the cases pass the apparatus, but instead some form of bottle gripper must be inserted over the edges of the cases to grasp each bottle therein, thereby requiring synchronization in the position and operation of the grippers with respect to the motion or position of cases within the case unloader.

There are two types of full depth uncaser grippers which are commonly used. The first type of gripper is characterized as having a substantially rigid outer cup-like structure, with the open portion directed downward so as to be disposable over the tops of the bottles. Within the top is a generally angular, flexible (usually rubber) inner wall sealed with respect to the top so that the region between the flexible inner wall and the cup may be pressurized to encourage the inner wall to a smaller diameter to close around the neck of a bottle. Thus, when the gripper is placed down near the neck of a bottle, there is clearance between the neck and the flexible inner wall. However, upon pressurization of the gripper, the inner wall moves inward to grasp the neck of the bottle and retain the bottle with respect thereto. Characteristically, this type of gripper is supported in a downward projecting direction by a rubber member supported by some form of continuous belt or chain system coordinated with respect to the motion of cases thereunder to reach into the cases, grasp bottles, lift them free of the case and deliver them to a delivery station.

The grippers described above operate well under most conditions. However, they have certain characteristics which cause occasional problems, and are subject to deterioration and puncture so as to require occasional replacement. By way of example, if a bottle in a case has a broken neck, the sharp edges may cut and puncture a gripper. Similarly, excessive pressure sometimes presented in an effort to increase the speed of operation of the device may result in deterioration and blow out of a gripper, particularly if the equipment is operated without bottles passing therethrough. Also, the screw cap bottles, also referred to as convenience closure bottles, as often returned with the caps thereon (as specifically requested) or at least loosely disposed over the tops of the bottles. Thus, the gripper may grip such a cap and remove it from the bottle but not release the cap at the position where the bottle should have been released, so that the cap remains in the gripper to jam the gripper from further operation. Also, if a bottle in a case is tilted or upside down, that bottle may force the corresponding gripper to the side so as to interfere with the proper disposition of surrounding grippers, thereby resulting in as much as one-half of the case or more not being unloaded as a result of the problem with merely one bottle in the case. Obviously, this equipment requires a substantial supply of compressed air, as well as expensive valving, plumbing, etc. to couple the air supply to the individual grippers and to coordinate the action of individual grippers.

The second type of full depth uncaser utilizes a purely mechanical gripper having a pair of gripping fingers spring-loaded to the closed position, but encouragable to the open position by the engagement of an actuating member with a cam surface as the grippers move along their predetermined track determined by a continuous chain system. These grippers are characterized as requiring considerable motion of the grippers along their predetermined paths of travel for the gripper to either open or close, since a significant length of cam engagement is required to force the gripper to the open position, or conversely to allow the gripper to smoothly return to the closed position. Consequently, such gripper follow a predetermined path characterized by motion having a substantial downward component to project the gripper into a case while the gripper is in the open condition, followed by a substantially horizontal motion during which time the gripper is allowed to close, then followed by motion having a substantial upward component to lift the bottle out of the case. Since all grippers are supported on a continuous chain arrangement, the horizontal component of velocity of the grippers during these three segments of the chain path cannot be equal, whereas the horizontal velocity of the cases under the grippers is uniform. Thus, such grippers are characterized as having some elongated characteristic in a longitudinal direction so as to allow some longitudinal motion of the bottles with respect to the grippers. Since the grippers must be accurately inserted into the case, the net result is that the grippers, and particularly the bottles, tend to drag against the edge of the cases when being lifted therefrom, resulting in substantial swinging of the bottles once free of the case. Also, such gripper tend to be mechanically complex, and close to a fixed position so as to grasp the bottles with varying degrees of security depending upon the exact size of the neck of the bottles. In this regard, the grippers are purposely fabricated so as to not firmly grasp the bottles, since some longitudinal sliding of the bottles in the elongated grippers is desired to accommodate the variations in the horizontal component of velocity of the grippers with respect to the cases.

BRIEF SUMMARY OF THE INVENTION

A Full Depth Uncaser for automatically removing bottles from a case having a depth substantially equal to the bottle height, and delivering the bottles to a delivery conveyor. The Uncaser utilizes a first conveyor system for delivering cases full of bottles to a gripper system which grips the bottles, removes them from the cases and deposits the bottles on a delivery conveyor. The gripper system utilizes groups of individual grippers arranged in the general pattern of the bottles in the cases, with the various rows of grippers supported by continuous chains at each side of a gripper assembly. Each individual gripper utilizes an over-center toggle mechanism held to the open position by the toggle, and triggerable by the contact of a center member with the top of a bottle to allow a spring to cause the gripper to close on the neck of the bottle. Bottles are released onto the delivery conveyor by depression of the center member at that point. Gripping of individual bottles is rapidly achieved, with the horizontal component of velocity of the grippers being equal to the velocity of the case. Provisions for synchronizing the cases with the gripper motion as well as other features and improvements for such equipment are disclosed.

BRIEF DESCRIPTION OF THE DRAWINGS

FIG. 11 is a typical cross-section of the transport means illustrating the manner of guiding the chains and cam members.

FIG. 12 is a cross-section taken along line 12—12 of FIG. 11.

FIG. 13 is a cross-section taken along line 13—13 of FIG. 11.

FIG. 14 is a cross-section taken along line 14—14 of FIG. 11.

FIG. 15 is a cross-section taken along line 15—15 of FIG. 1.

FIG. 16 is a cross-section taken along line 16—16 of FIG. 1.

FIG. 17 is a cross-section taken along line 17—17 of FIG. 1.

FIG. 18 is a top view of the guide track in the region 300 of FIG. 15.

FIG. 19 is a view of the sprocket 508 taken on an expanded scale.

FIG. 20 is a block diagram illustrating the case synchronizing control system.

DETAILED DESCRIPTION OF THE INVENTION

Figures 1, 2, 3, 4:
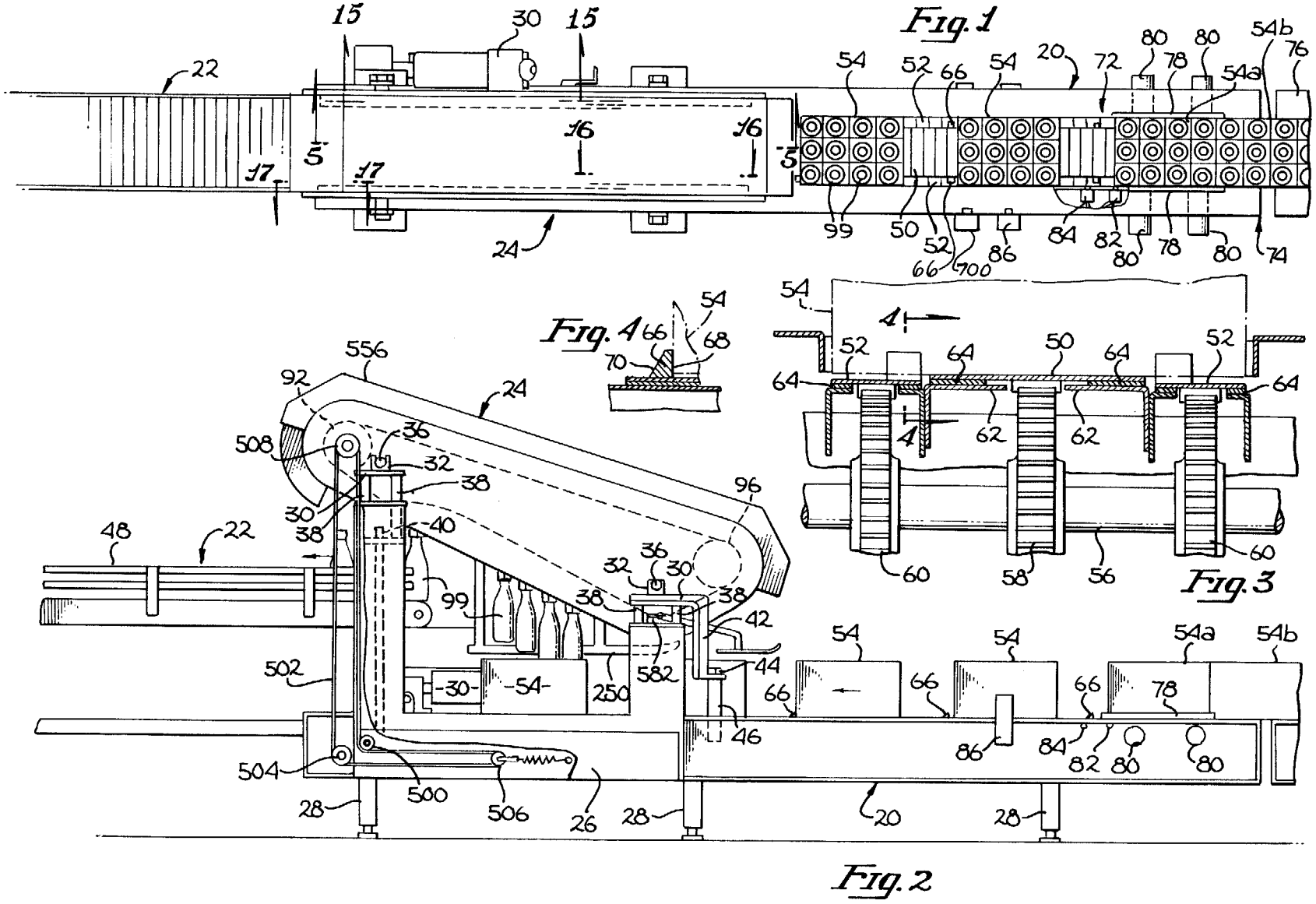
FIG. 1 is a top view of the uncaser of the present invention.
FIG. 2 is a side view of the uncaser.
FIG. 3 is a cross-section of the input conveyor illustrating the drive means therefor.
FIG. 4 is a cross-section taken along line 4—4 of FIG. 3.

First referring to FIGS. 1 and 2, a top view and a side view respectively of the present invention bottle uncaser may be seen. The Uncaser is characterized by an input conveyor, generally indicated by the numeral 20, a delivery conveyor, generally indicated by the numeral 22, and an uncasing head generally indicated by the numeral 24 and located on and supported by a frame assembly 26. The frame assembly as well as the input conveyor, generally integral therewith, is supported on adjustable feet 28. On the frame assembly is a conventional drive motor means 30 and an elevation adjusting means for adjusting the relative elevation of a head 24 with respect to the input conveyor 20 and delivery conveyor 22. The elevation adjusting means adjusts the elevation of plates 30 and particularly yokes 32, in which the uncasing head 24 rests by means of pins 36. This elevation adjusting means is comprised of cylindrical members 28 slideably engaging the frame assembly and driven in vertical motion by lead screws, such as lead screw 40, to adjust the elevation of the uncasing head. The screws for all four support points are driven by a common chain drive system, so that both the forward and rear portion of the uncasing head are adjustable simultaneously in accordance with the size of the bottle being uncased. The elevation adjusting means is described in more detail in the patent entitled Case Unloading Machine U.S. Pat. No. 3,570,693, heretofore referred to. The plates 30 on the forward lower adjustment means have an integral downward extension 42, with a support yoke 44 attached to the piston of a compressed air cylinder-piston assembly 46 supported on the downward extension 42. The purpose of this support yoke 44 is to provide a support and adjustment means for a half depth uncasing depth of the type disclosed in the hereinabove mentioned patent, with the air cylinder 46 providing one of the features covered in that patent. Thus, the basic frame assembly 26, together with the input conveyor 20 and the output conveyor 22, may be utilized with the uncasing head 24 of the present invention, or may be utilized to uncase half depth cases utilizing an uncasing head as described in the heretofore mentioned patent.

The delivery conveyor, generally indicated by the numeral 22, is a conveyor of generally conventional construction driven by the drive motor 30, and is provided with side fences 48 to prevent the accumulation of bottles on the conveyor from forcing the bottles off the side thereof. Thus the bottles are deposited on the conveyor to be delivered to a bottle washer or other apparatus as may be appropriate in the particular application.

The metal chain conveyors for the input conveyor are similar to that used for delivery conveyor. However, three conveyor chains are actually used. There is provided a relatively wide center conveyor chain 50, with narrower side chains 52 disposed on each side thereof. The chain 50 is at a slightly higher elevation than the chain 52, and in fact is driven at a slightly higher linear speed than the chains 52. Thus the cases 54 rest on the center chain 50 and are driven or carried along thereby.

FIG. 3 presents a cross-section of the input conveyor 20 at the sprocket drive position for the chains 50 and 52. The sprocket drive is provided by conventional drive means driving shaft 56 in rotation. Shaft 56 drives a central sprocket 58 driving chain 50, and a pair of side sprockets 60 driving the side chains 52. It is to be noted that all three sprockets are driven at the same angular velocity. However, sprocket 58, being larger in diameter, has a higher surface speed, and therefore drives chain 50 with a higher linear velocity. Each of the chains 50 and 52 rest on support members such as members 62, with intermediate self lubricating plastic members 64 minimizing wear and frictional drag on the chains.

Adjacent the inner edge of the outer chains 52 are blocks 66, which may also be seen in the cross-section taken along lines 4—4 of FIG. 3. The blocks 66 have a substantially vertically disposed face 68 directed so as to engage cases resting on chain 50, when those cases catch up to a respective pair of blocks 66 as a result of the higher speed of the center chains supporting the case. Thus it may be seen that cases resting on chain 50 between two pair of blocks 66 on the smaller chains will move at a higher velocity linear than the blocks until catching up with the blocks 66, at which time the velocity of the case and its position on the conveyor system will be determined by the velocity and position of the blocks 66.

It is to be noted in FIG. 4 that the back surface of the blocks 66, that is surface 70, is an inclined surface. While this has certain structural advantages, it also is functional in that in the event of any misadventure occurring under the uncaser head 24, an operator may grasp a case 54 as it is just about to enter the uncasing head and hold it at that point, with the blocks 66 encouraging the cases to an upward position to allow the blocks to slide thereunder as the input conveyor system continues to operate.

The smaller chains 52 extend outward to the position generally indicated by the numeral 72 (FIG. 1). The larger center chain 50, however, extends outward to the position indicated by the numeral 74. Beyond that position may be a conventional roller or ball bearing type unpowered delivery conveyor 76. Thus, cases such as cases **54*a* and 54*b* may be delivered by unpowered conveyor 76 to first engage the larger center chain 50 to be carried along thereby. Prior to position 72, there is provided a pair of sidewise moveable members 78, facingly disposed and driveable into clear separation by compressed air cylinders 80 supporting and driving each end of the members 78. The members 78 are covered on their inward faces with rubber so as to be frictionally engageable with the sides of cases to retain the cases at that position, allowing the chain 50** to slide thereunder.

There is further provided three photoelectric sensors 82, 84 and 86. These sensors, as shall be subsequently described in detail, are for sensing the position of cases 54 to provide for the timely release of case 54a with respect to the cooperative position of a pair of blocks 66 on the smaller chains, so that the released case will come to rest against the blocks before entering under the uncaser head 24.

Figures 5, 6:
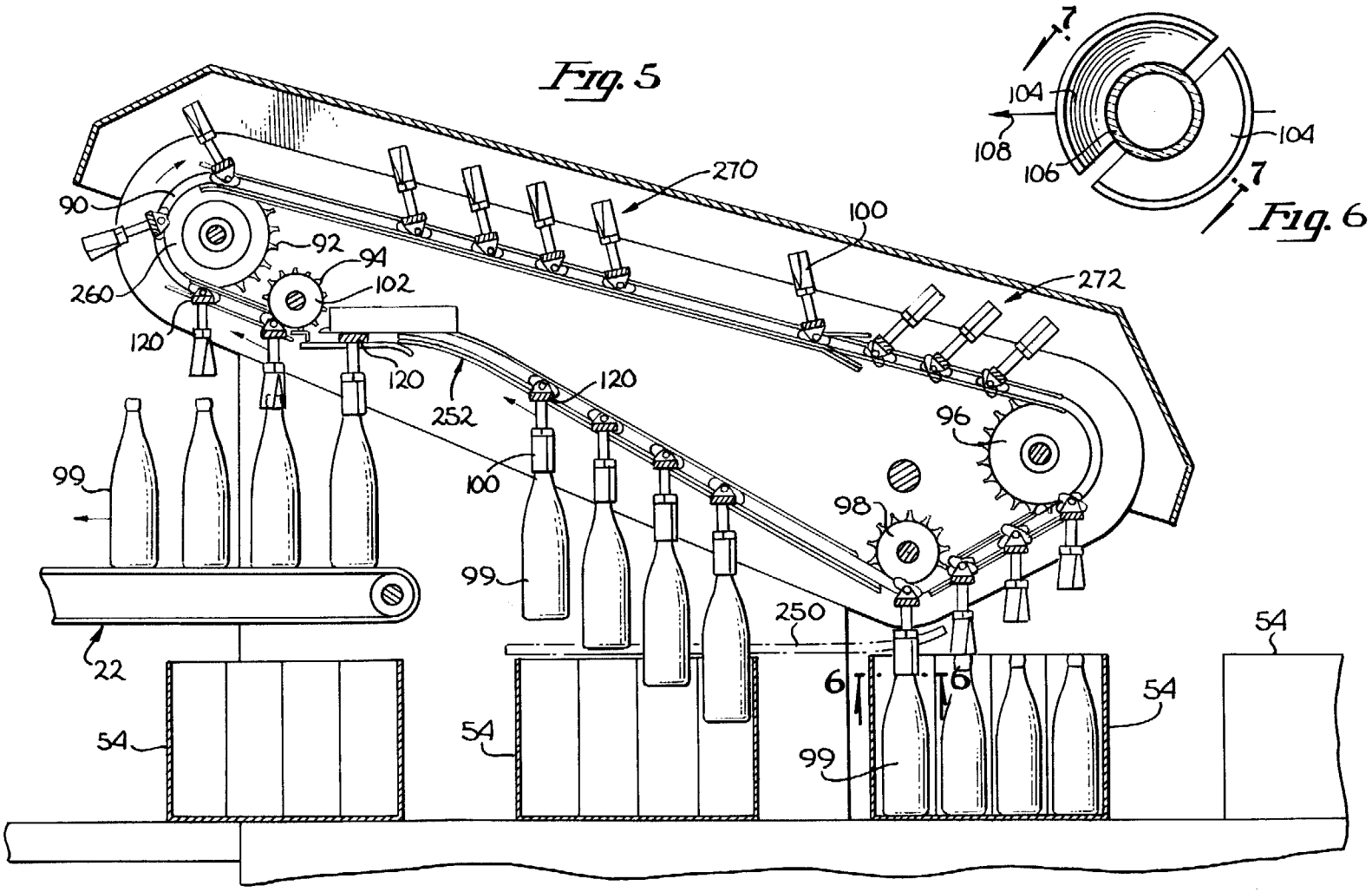
FIG. 5 is a cross-section taken along line 5—5 of FIG. 1.
FIG. 6 is a cross-section taken along line 6—6 of FIG. 5.

Now referring to FIG. 5, a cross section taken along lines 5—5 of FIG. 1, illustrating the basic operation of the uncasing head 24, may be seen. The uncasing head utilizes a pair of continuous chains, indicated by the numeral 90, at each side thereof, with the chains being guided in a predetermined path by a combination of sprockets 92, 94, 96 and 98 as well as by various slide tracks between sprockets to support and guide the chain. Mounted between the chains are a plurality of cross bars 120, each supporting grippers 100, which are adapted to grip the necks of the bottles just below sprocket 98, to support the bottles as they are lifted from the cases, and to release the bottles as the grippers pass by rollers 102 mounted on the same shaft as the sprockets 94.

The construction of the individual grippers is illustrated in FIGS. 6 through 10. FIG. 6 is a view taken along line 6—6 of FIG. 5, illustrating the general orientation of the grippers in the uncaser with respect to the path of the cases thereunder. In particular, two gripper members 104 are adapted to close on the neck of a bottle 106, with the gripper members 104 being split into separate members along a plane inclined at 45 degrees with respect to the directional motion of the cases, generally indicated by the arrow 108. The purpose of inclining the grippers in this manner is to allow the greater separation of the gripper members 104 when the gripper is in the open condition without interference with the adjacent grippers. This 45° inclination is also indicated in FIG. 5. However, in the remaining figures, that is FIGS. 6 through 10, for purposes of illustration and clarity, the plane separating the two gripper members 104 has been oriented in the fore and aft direction so as to allow a more illustrious description of the operation of the grippers. Such an orientation is of course both operative and satisfactory, though the 45° inclination previously described allows greater room, particularly for gripper patterns for smaller bottles.

Figure 7:
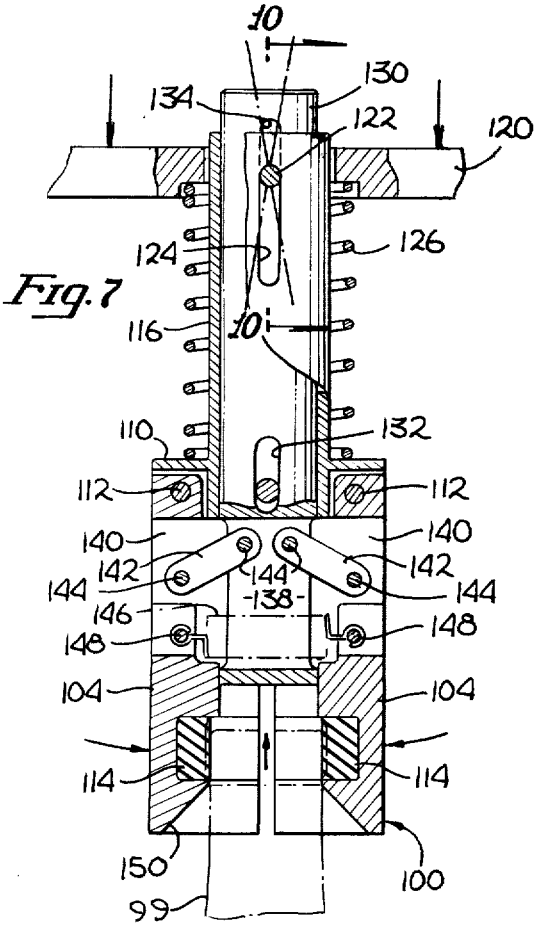
FIG. 7 is a cross-section taken along line 7—7 of FIG. 6.
Figure 8:
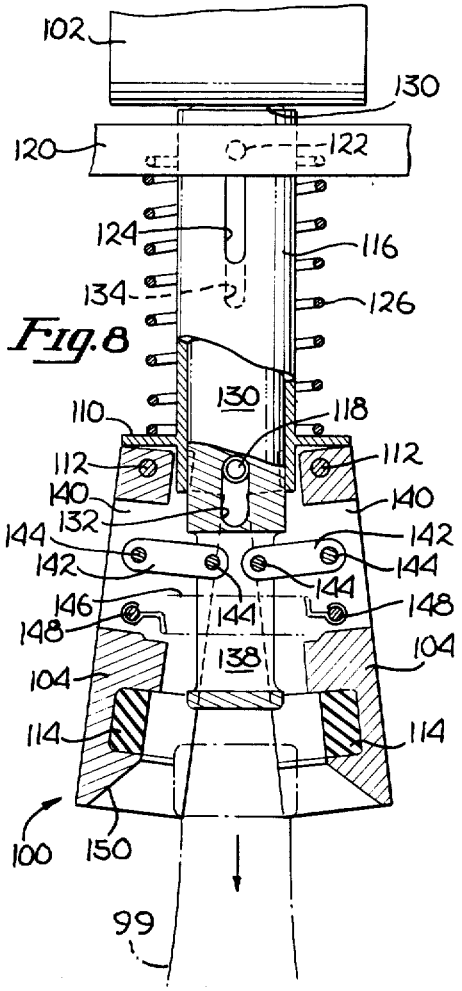
FIG. 8 is a partial cross-section similar to the cross-section of FIG. 7 illustrating the grippers in the open position.
Figure 9:
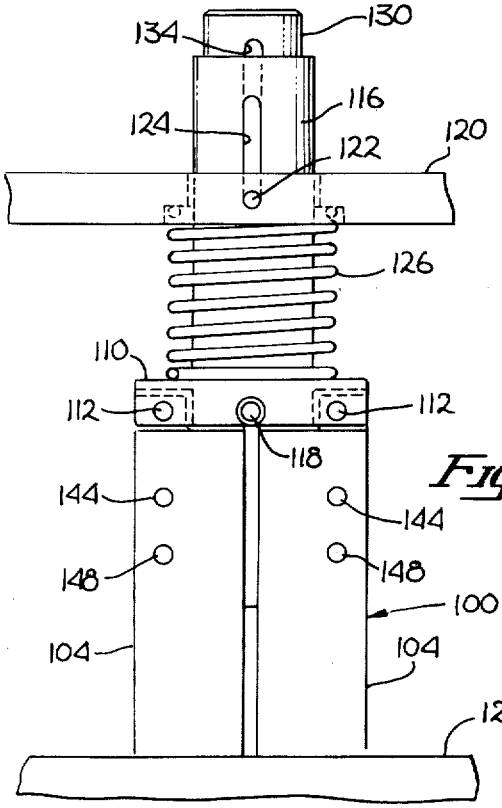
FIG. 9 is a side view of a gripper illustrating the operation thereof upon incurring an obstruction.
Figure 10:
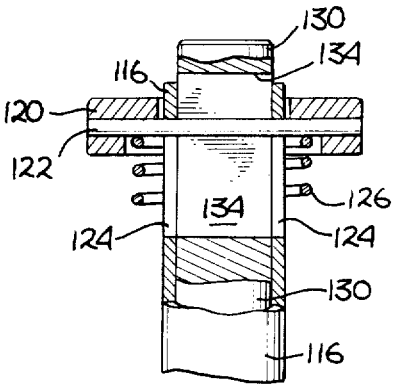
FIG. 10 is a cross-section taken along line 10—10 of FIG. 7.

The grippers are comprised of first and second gripper members 104, together approximately defining an annular structure. Each of the gripper members 104 extend upward into an appropriately disposed support member 110, and are rotationally supported thereby by pins 112. Thus, the gripper members 104 may rotate about the pins from a closed position as indicated in FIG. 7 to an open position, indicated in FIG. 8. The gripper members 104 are provided with rubber inserts 114, disposed so as to be engageable with the neck or top of a bottle to provide increased friction therewith and to cushion the impact of the gripper members onto the bottle top. The support members 110 are retained to a metal cylindrical member 116 by a pin 118. The cylindrical members 116 extend upward to be retained by a cross member 120, forming a portion of the transport means, by a pin 122. The cylindrical member 116 has a slot 124 therein so as to be moveable, within limits, in a vertical direction. A coil spring 126, extending between member 110 and a cross member 120, yieldably encourages the gripper assembly into the position shown in FIG. 7, but upon striking an object such as the base of an upside down bottle 128, the gripper assembly may move upward with respect to the cross bar 120 by the compression of the coil spring, as shown in FIG. 9.

Within the cylindrical member 116 and extending downward between the two gripper members 114 is an actuator member 130. This member extends upward above the top of cylindrical member 116 and downward so as to be engageable with the top of a bottle as shown in FIG. 7. The actuator member 130 is adapted for vertical motion within the limits defined by the slot 132 in the actuator member through which pin 118 passes. The actuator member 130 also has a slot 134 through which pin 122 passes, so as to not restrict motion of the actuator member by the pin 122. The actuator member has a large slot 138, with cooperatively disposed slots 140 in the gripper members 104. Within these slots are a pair of coupling members 142 each coupled to the actuator member and one of the tripper members at the ends thereof by pins 144. Adjacent the bottom of slots 140 (the slot being somewhat narrower in this region) is a coil spring 146 loaded in tension and supported as shown by pins 148. Thus, with the actuator member in the position shown in FIG. 7, coil spring 146 encourages the two gripper members into closer separation, thereby forcing the rubber inserts 114 against the top portion of the neck of a bottle 99. When engaging a bottle as shown, pin 118 not quite engages the bottom of slot 132, so that the actuator member 130 will not restrict the closing of the gripper members 114.

The cross members 120 are supported at the ends thereof by the chains 90 (FIG. 5) in a manner to be subsequently described in greater detail. However, it is to be noted that at the release point for the bottles, the cross bars 120 pass under rollers 102 which are aligned with the grippers. This is shown in detail in FIG. 8, where it is shown that a roller 102 is disposed so as to engage and depress the top of the actuator member 130, thereby forcing the gripper members 104 to the open position and further deflecting the coupling members 142 past "center" so as to lock the gripper assembly at that condition by the orientation of the coupling members 142, the coil spring 146 and the engagement of pin 118 with the top of the slot 132 in the actuator member. It should be noted also that when the gripper is open, as shown in FIG. 8, thereby releasing the bottle 99, the gripper may still be forced upward against the coil spring 126 in the same manner as shown in FIG. 9. Further, it should be noted that since the gripper is normally supported by the engagement of pin 122 with the top of slots 124 in member 116, thereby supporting the assembly fore and aft of the actuator member, engagement of the actuator member 130 with the roller 102 provides an aligning force on the gripper, encouraging it to remain in the vertical orientation.

When a gripper progresses to a position just below sprocket 98 (FIG. 5) the lower end of the actuator member 130 will engage the top of bottle 99 so as to be forced slightly upward, thereby tripping the over-center mechanism and allowing the coil spring 146 to pull the gripper members 104 against the side of the neck of the bottle, and forcing the actuator member 130 further upward. Thus it may be seen that the gripper members 104 are coupled to an over-center mechanism or toggle mechanism, which may retain the grippers in the open position but allow the rapid triggering of the mechanism for the engagement of the actuator member with the top of a bottle to provide almost instantaneous gripping of the neck of a bottle. In the event no bottle is disposed beneath the gripper as it passes sprocket 98, the gripper will remain in the open condition until again passing sprocket 98 and engaging a bottle. Similarly, once the grippers are opened by roller 102, they will remain open until engaging a bottle so as to close. Thus it may be seen that the rubber inserts 114 both cushion the impact of the gripper members 104 with the neck of the bottle, and further provide a relatively high frictional force therewith, (the gripper members 104, coupling members 142 and the actuator member 130 in the preferred embodiments are of the self lubricating molded plastic).

The lower portion of the gripper members have a chamfer 150 thereon so as to encourage the alignment of the gripper with the top of a bottle as it proceeds downward into a case. For this to be accomplished in the event of misalignment, a bottle neck may generally be horizontally deflected for gripping. To further accomodate this action, the hole in the cross member 120 through which metal cylindrical member 116 passes is purposely made a predetermined amount larger than the cylindrical member so as to allow for some sidewise deflection of the lower portion of each gripper to align the gripper with the bottle. This sidewise motion, however, is limited by the binding of cylindrical member 116 with the hole so as to prevent the sidewise deflection from being excessive as to interfere with the operation of the neighboring grippers.

Now referring to FIGS. 11 through 14, and with reference to FIG. 5, certain of the details of the transport means may be seen. Each of the cross members 120 has a small metal endplate 152 fastened thereto. A cam member 154 has an axle pin 156 fastened thereto by a retaining pin 158. The axle pin 156 extends through a hole in the endplate 152 and is retained with respect to the endplates by a coil spring 160 and snap ring 162. Thus, cam member 154 is yieldably encouraged toward engagement with endplate 152. A pair of balls 164 are disposed in pockets in the face of cam member 154, so as to be encouraged into mating holes 166 in the endplate. Thus, the cooperative function of these parts is to provide a detent by the engagement of the balls with the openings 166 to yieldably lock the cam members 154 in a predetermined position with respect to the endplate. Thus, if cam members 154 are restrained to their rotation, endplates 152 may be forced by an inadvertant extraordinary force to rotate from the detent position, though the endplates will remain in the detent position under normal conditions, so that an extraordinary requirement may be required to do so.

The axle pin 156 extends outward into a hole 172 in a chain slide member 170. The chain slide member 170 in turn has a pair of pins 174 pressed therein which pins have a spacing so as to be insertable into a pair of hollow pins of the chains 90 providing the basic drive for the transport system. The lateral disposition of the grippers and the number of grippers disposed on a crossbar 120 will depend upon the lateral distribution of bottles within a case. Similarly, the longitudinal disposition of bottles within the cases will determine the separation between adjacent crossbars. Since the spacing of bottles may not be in fixed relation to the chain length dimensions in the preferred embodiment, three functionally equivalent but dimensionally different chain slide members 170 are provided so that the cross members 120 may be spaced within a matter of few tens of thousandths of an inch from the ideal location. In particular, the holes 172 in these three chain slide members are located at different positions with respect to the pins 174 therein. Thus, since none of the chain slide members have the pins centered, six cross bar positions may be selected by using either of two positions for either of the three standard chain slide members. Also, obviously changes in spacing may be readily made, if necessary, due to the lack of permanent attachment to the chains.

Now referring specifically to FIG. 11, it will be noted that each of the side plates 200 of the uncase head assembly 24 are provided with channels defined by channel plates 202 having a self lubricating plastic liner 204. These channel plates are generally provided throughout the path of travel of the chains 90. The channel plates retain chain 90 at both sides of the assembly. On the right hand side of FIG. 11, it may be seen that the channel plates further extend in and provide a slide for chain slide members 170. On the left hand side of this figure, the channel plates provide a slide region not only for the chain slide members 170, but further extend inward to provide a slide region for cam members 154. Thus, cross member 120 is restrained in rotation about a horizontal axis in FIG. 11 by the retention of the cam member 154 between the channel plates on the left hand side of the figure. Thus, this figure is representative of the cross sections in the transport means between the sprockets 96 and 98 (FIG. 5). Accordingly, cam members 170 on one side of the uncaser head (the left side) engage a restraining track in the region between sprockets 96 and 98 so as to retain the cross members 120 in a horizontal disposition in that region (e.g., the grippers in a vertical disposition). Cross-sections taken along lines 12—12 and 13—13 of FIG. 11 showing the two sides and the disposition of the cams are shown in FIGS. 12 and 13 respectively. For purposes of clarity, the various cam members 154 and chain slide members 170 are identified in some of the following figures by the appropriate numerals folled by an L or R to designate the left or right sides of the transport means as viewed in the direction of movement, i.e. from input conveyor 20 toward delivery conveyor 22. Thus, in FIG. 12, the cam member 154L may be seen in line with the chain follower 170L (not shown) immediately therebehind. In FIG. 13 the cam member 154R on the right side of the assembly may be seen not aligned with the (narrower) track or the chain slide member 170R riding therein. Thus, it may be seen that the angular disposition of cross member 120 about a horizontal axis may be controlled by the engagement of either cam members 154L or 154R with extentions of the chain slide track, with FIG. 11 specifically illustrating the alignment of cross member 120 by the left cam member 154 designated 154L in FIG. 12.

Now referring to FIGS. 15, 16 and 17, further details of the transport means may be seen. FIG. 15 is a cross-sectional view taken along lines 15—15 of FIG. 1, showing the right side of the transport means. FIGS. 16 and 17 are cross-sections taken along lines 16—16 and 17—17 of FIG. 1, illustrating the left side of the transport means. As a typical cross member 120, such as member **120*a* shown in FIG. 16, proceeds through the region between sprocket 96 and sprocket 98, it is maintained in a horizontal disposition and therefore the grippers in a vertical disposition by engagement of cam member 154L with the channel plates defining the chain slide region. In the region of sprocket 98, the grippers grip the bottles as hereinbefore described. Similarly, at sprocket 98 as well as in positions beyond sprocket 98, such as the position of the cross member 120*b*, neither cam member is guided or restrained (though the chain slide members are always guided on both sides of the transport means), so that the cross members and the gripper maintain their horizontal and vertical dispositions respectively as a result of the high pendulosity thereof (caused by the bottles hanging therebelow though the pendulosity in the grippers along is adequate for this purpose). It should be noted that in the region between sprockets 96 and 98, the grippers proceed downward at a relatively high rate due to the angle of the track in this region, and further rapidly change direction because of the relatively small size in the sprocket 98 to then proceed upward at the same angle. Consequently, the horizontal component of velocity of the grippers in the downward portion of the transport means path in this region is equal to the horizontal component of the grippers in the upward portion of their motion beyond sprocket 98. Consequently, there is not significant relative horizontal component of velocity between the grippers and the cases, as they proceed under the region of sprocket 98. Thus, there is no tendency to longitudinally drag the bottles with respect to the cases or the cases with respect to the bottles, unlike the prior art systems. The lack of said dragging is made possible by the rapid gripping action of the individual gripper upon initial contact with the bottle, which in turn avoids any significant substantially horizontal section of track in place of sprocket 98**.

There is provided a skate like member 250 (FIGS. 2 and 5) disposed just above the path of the cases in the region of gripping, and further disposed so that the bottles pass to either side thereof. This member assures that the cases and/or bottle separators within the cases are not allowed to rise as the bottles are lifted out of the cases. Once the bottles are lifted free and clear of the cases, the chain guides curve in a region generally indicated by the numerals 252 to define a short section of horizontal track. Slide members 254 and 256 are disposed so as to engage the cross members 120 in this region, to assure that they are horizontal. Accordingly, as the chains pass around sprockets 94, the rollers 102 aligned with each longitudinal row of the grippers, depress the actuating members 130 to open the grippers and release the bottles, thereby allowing the bottles to freely rest on the delivery conveyor. At the same time, as may be seen in FIG. 15, the right hand cam member 154R, will engage and be guided by the track in the region between the rollers 102 and the end sprocket 92, thereby assuring that the cross members 120 are maintained in horizontal position during this portion of the path to avoid tipping over the bottles deposited on the conveyor.

Mounted on the same shaft as sprocket 92 and aligned with the trajectory of a portion of the cam member 154R is a circular member 260, which will engage the cam members 154R, causing them to rotate with the member 260 until being deposited into an upper return track, generally indicated by the numeral 262. The return track has a lip member 264 projecting past the edge of member 260 so as to engage the cam followers at the point to assure that they properly enter the return track.

As may be seen from FIG. 5 the grippers as they enter the return track are not at the proper angle with respect to the chain tracks to eventually project perpendicularly downward into the cases at the pick-up point under sprockets 98. Consequently, the angle of the grippers with respect to the chain track must be changed from that of the region generally indicated by the numeral 270 to that in the region generally indicated by the numeral 272. To accomplish this, the determination of the angularity of the cross members 120 must be changed from the right hand cam member 154R to the left hand cam member 154L. To accomplish this change over, the slide in which the cam members 154R are guided in the initial return path into an expanding region, generally indicated by the numeral 300 (FIG. 15), thereby gradually releasing the previous guidance of the cam members. At the same time, the left hand side of the transport means (FIG. 16) is provided with a decreasing taper in the cam buide region, generally indicated by the numeral 302, so as to gradually change the guidance of the cam members 154 from the right hand side to the left hand side, thereby changing the angularity of the cross members 120 as shown. The top view of the right hand track in the region 300 may be seen in FIG. 15. It may be noted therein that the track in the region 320 is sufficiently wide to engage both the chain slide member and the cam member, with the area 322 engaging the cam member tapering and finally terminating so that the track in the region 324 only engages the chain slide member and not the cam member.

Like sprocket 92, sprocket 96 also has a circular member 306 attached thereto to guide the cam members 154L around the sprocket into the section of track leading to the pickup point below sprocket 98. To insure smooth transition of the cam member on and off the circular member 306, projections 308 and 310 adjacent the edge of the circular member 306 guide the cams in this region.

There has heretofore been described a unique gripper for gripping individual bottles by the tops thereof, together with a continuous transport means for causing the grippers to engage the necks of bottles in cases passing thereunder on a first conveyor, and depositing the bottles onto an output conveyor. To achieve the desired result, cases must be appropriately released by the members 78 (FIG. 1) in coordination of the motion of the smaller chains 52 in the input conveyor, so that the cases are aligned with the sets of grippers in the uncasing head. To achieve this result, the photosensors 82, 84 and 86 are used to sense the position of the chain and/or cases and to cause members 78 to release cases at the appropriate time. In particular, each of the photo cells 82, 84 and 86 provide a signal to a control circuit 400, as shown in FIG. 20. The control circuit 400 combines the signals in a predetermined manner to provide a control signal to a solenoid valve in the compressed air line coupled to cylinders 80. Of course, other actuators for members 78 may also be used if desired.

Photo cell 82 is positioned so as to sense a case located between members 78. Photo cell 84 is positioned to sense the passage of a pair of reference blocks 66 in the smaller chains, and photo cell 86, positioned a case length forward of photo cell 82, is positioned at an elevation so as to sense passage of a case, but not the passage of only a pair of reference blocks 66. Whenever the photosensor 82 is light, members 78 should be in the withdrawn position, since such a condition indicates that no cases are either in proper position between members 78 or are passing beyond that region toward the uncasing head. When the first case reaches the photosensor 82, the control circuit will cause members 78 to close on the case to retain it at that position. When the photosensor 84 senses the passage of a pair of reference blocks 66, the control circuit will cause members 78 to be withdrawn to release one case which eventually will catch the corresponding pair of blocks. It will be noted, however, that assuming there is a supply of cases behind the case released, a steady stream of cases would be delivered to the uncaser, thereby keeping both photo sensors 82 and 84 dark and holding members 78 in a withdrawn position. To avoid this, the photosensor 86 is provided to sense the passage of cases thereby. Thus, when photosensor 86 first goes dark, the control circuit causes members 78 to close on a case. A time delay in the control circuit causes photosensor 86 to maintain members 78 in a closed position until the end of the case sensed by photosensor 86 at least passes the photosensor 84, at which time photosensor 84 itself will cause members 78 to be in the closed position until sensing a subsequent pair of reference blocks 66. Thus, it may be seen that the signals of the photosensors are logically combined in the control circuit, to cause the periodic opening and closing of members 78 to release cases in a coordinated manner with respect to the reference blocks 66 on the small chains, so that cases may be delivered to the uncasing head in synchronization with the operation of the transport means in the head.

Since the transport means in the uncasing head must be synchronized with the input conveyor system, a means should be provided to advance or retard the operation of the uncasing head to achieve this synchronization. In the preferred embodiment, the uncasing head drive is provided through a driven sprocket 500 and chain 502 with an idler sprocket 504 and a second idler sprocket 506 to allow for a chain pick-up during adjustment of the height of the uncasing head. Sychronization may be achieved in part by changing the engagement of chain 502 by the desired number of links with respect to the teeth of sprocket 508 on the uncasing head. To provide for a even more accurate adjustment, a special adjustment mechanism is provided with sprocket 508 as shown in detail in FIG. 19. In particular, the sprocket 508 is adapted for free rotation from the shaft 510 but is bolted by bolts 512 to a member 514 which is keyed to the shaft key 516. The bolt 512 passed through slot 518 in member 514 so that the bolts may be loosened and the sprocket turned the desired amount up to at least one chain link length to achieve the fine adjustment desired.

Figure 21:
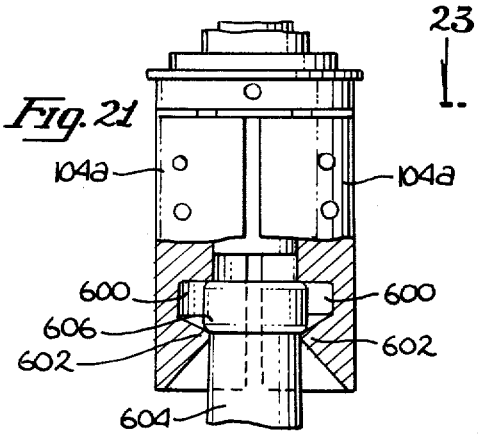
FIG. 21 is a partial cross section of an alternate gripper design.
Figure 22:
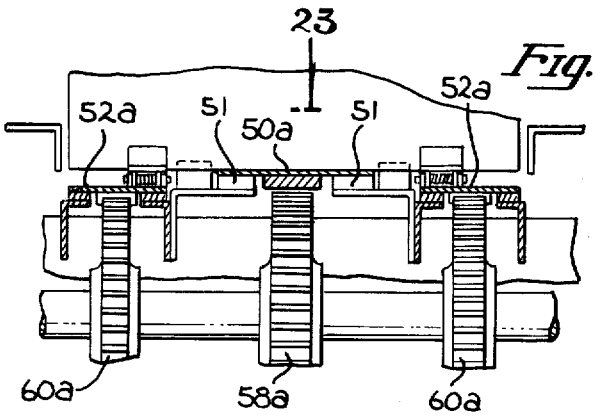
FIG. 22 is a view of the drive sprocket system for the alternate conveyor system for the present invention.
Figure 23:
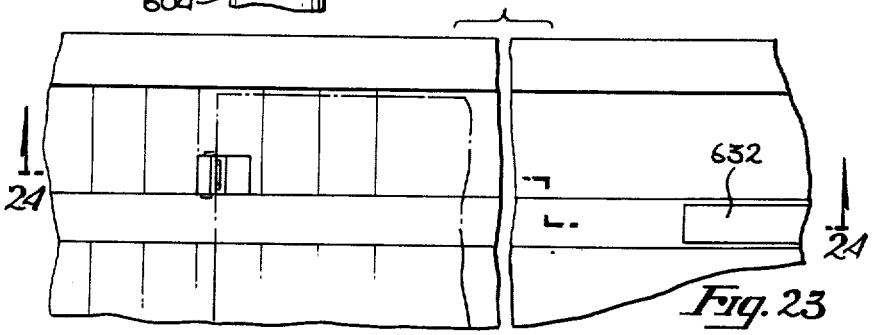
FIG. 23 is a top view of the conveyor of FIG. 22.
Figure 26:
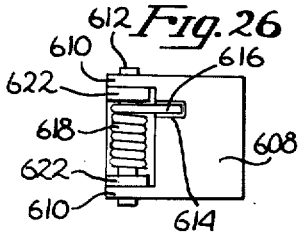
FIG. 26 is a view of the bottom of one of the cleat mounting members taken along line 26—26 of FIG. 25.
Figure 24:
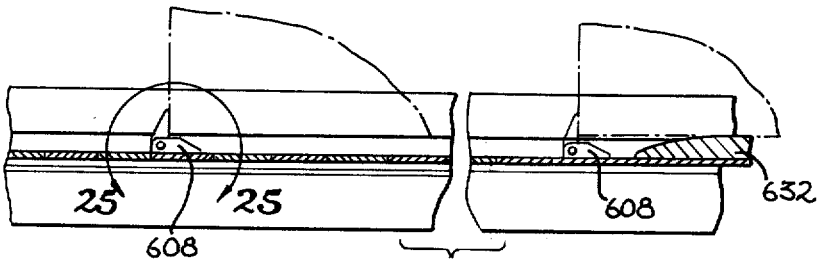
FIG. 24 is a cross section of the conveyor taken along lines 24—24 of FIG. 23.

An alternate gripper design is shown in FIG. 21. In this gripper, otherwise identical to the gripper hereinbefore described, the gripper members 104A each have a relief 600 proportioned so that the lower lip 602 thereof engages the neck of a bottle 604 just below the top flange 606. Accordingly, gripping in this embodiment is by way of mechanical engagement, as opposed to frictional engagement. In this manner, positive gripping is assured even with wet and/or slippery bottles.

An alternate case transport and synchronizing means is shown in FIGS. 22 through 27. In this embodiment, the chain sprockets 60A and 58A are the same size, so that the outer chain members 52A and the inner chain members 50A travel at the same surface speed. However, the inner chain members 50A are spaced further outward in the operative part of the track between sprockets by the spacers 51, fixed to the conveyor frame, so that the center chain members 50A are higher than the outer chain members 52A in the operative part of the track.

Figure 25:
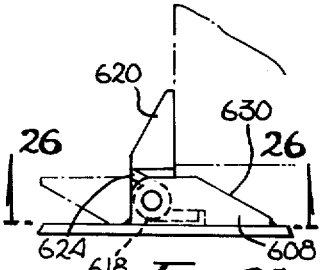
FIG. 25 is an exploded view of one of the cleats taken along the line 25—25 of FIG. 24.

At various positions along chain members 52A are welded cleat mounting members 608 with a predetermined spacing to coincide with the case spacing requirements for synchronization with the groups of grippers on the uncasing head. The cleat mounting members 608 have rearward extending flanges 610 to accept a pivot pin 612. The cleat mounting members are also provided with a groove 614 at the bottom thereof to receive an end 616 of a coil spring 618. Cleats 620 are provided with flanges 622 which are supported by pins 612 and are also provided with a slot to receive a second end 624 of the coil spring 618. In this manner, cleats 620 are spring loaded to the vertical position as shown in FIG. 25, but upon sufficient force will deflect to the position shown in phantom in that figure. Also, the thickness of the cleats and the cleat mounting members is approximately equal to or less than the spacing provided by spacers 51, so that when deflected into the position shown in phantom in FIG. 25, the center chain members 50A will hold the case above both the cleat mounting members and the cleats. In addition, the leading edge 630 of the cleat mounting member 608 is tapered so as to encourage a case upward in the event any part of the case extends downward in that region. Finally, there is provided a pair of skid-like members 632 between the inner and outer chains, which members are slightly higher than chain members 50A. The skid members 632 are located at a position just before the cases proceed under the uncasing head and provide the final synchronization of the cases by raising the case off of chain members 50A and stopping the case until the next set of cleats 620 engage the case and encourage the case onward under the uncasing head.

Accordingly, in this embodiment the cleats 620 provide a positive drive to the case by pushing the case from behind, though if the case meets some obstruction, cleat members may deflect downward to allow the chain to continue even though the case has stopped. The advantage of this positive drive from behind is that it provides a driving force to continue the motion of the case in the presence of retarding forces such as those that may be encountered when using case strippers, that is, a stationary member mounted between rows of grippers to engage the top of the case and to prevent the case from lifting upward when the bottles are removed therefrom. Such strippers and other factors have a tendency to retard the case which may cause some wedging of the bottles in the case and resistance to their being lifted therefrom by the grippers. Thus, it may be seen that by using the cleat system, as hereabove described, ideal synchronization and drive for the cases is obtained provided there is also a means for releasing cases one at a time at any point between cleats.

Figure 27:
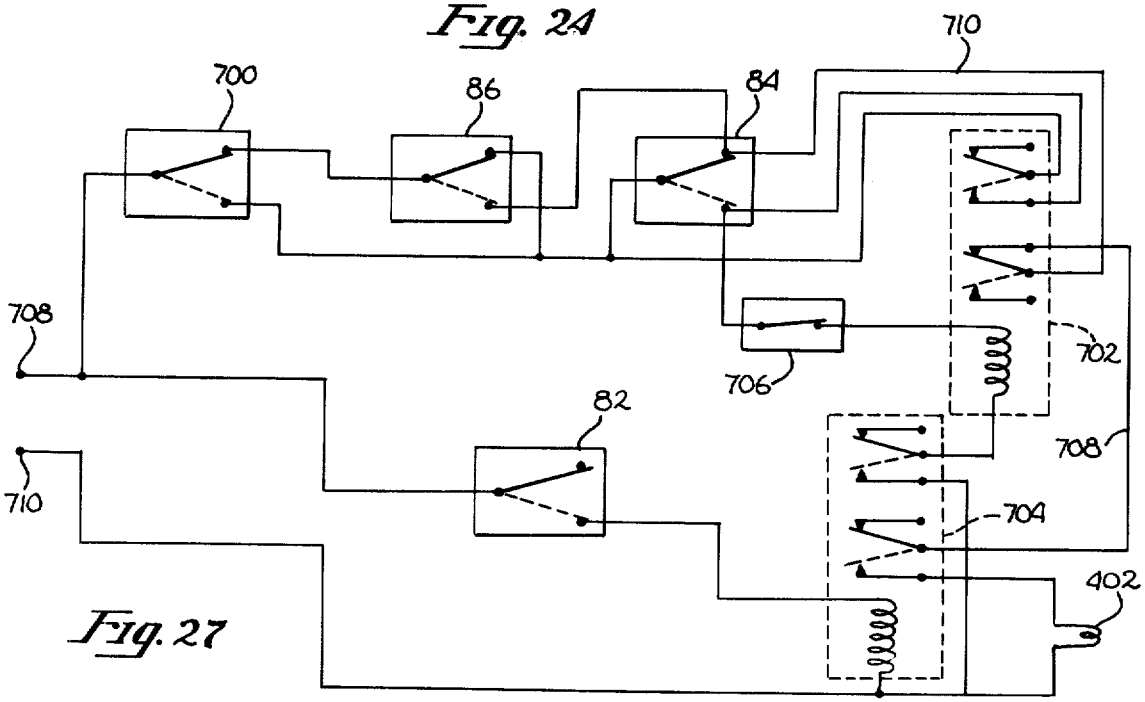
FIG. 27 is a circuit diagram of the case synchronizing system utilizing the alternate conveyor construction of FIGS. 22 through 26.

An alternate circuit diagram for achieving the required release is shown in FIG. 27. In this system, four photosensor switches and two double pole, single throw relays are used. Three of the four photosensing switches are generally located in the same positions as the three switches utilized with respect to the previously described system, and accordingly for easy reference with respect to FIG. 1 are again given their previous numbers. The fourth photo switch, also indicated on FIG. 1, has been identified as switch 700. The two relays are numbered 702 and 704, and in addition to the solenoid valve 402 there is also provided a switch 706 operated in conjunction with the main power control to the bottle conveyor power system.

All of the photoswitches are shown in their light position, and each will change to the opposite position shown in phantom when the photosensor is dark. Similarly, the relay contacts are shown in the unenergized condition. Power is applied on terminals 708 and 710, which in the preferred embodiment is 24 volts DC. It may be seen that as long as the case position sensor 82 is light, relay 704 will be unenergized, and accordingly the case stop solenoid valve 402 cannot be operated regardless of the condition of the other three photoswitches and the condition of relay 702. Thus, when the system has started without any cases therein, the solenoid valve will be unactuated and the movable members 78 (see FIG. 1) will be withdrawn. Accordingly, when the first case then enters the system photo switch 82 will sense the edge of the case, which in turn will energize relay 704 to change the switch contacts to that as shown in phantom in FIG. 27. This couples the solenoid 402 through line 708 to relay 702. However, it may be seen that power will not be delivered through relay 702 to line 708 unless the relay 702 is unactuated and power is applied thereto through line 710. These conditions depend in part upon the state of the switches 700, 86 and 84 as well as, in certain situations, the past history of these switches. There are a great number of possible states for these switches, only some of which will be described in detail herein as all are readily traceable by proceeding through the normal operating modes of the sequential machine by anyone of ordinary skill in the art.

When the uncaser is first turned on with no cases being delivered thereto, the photoswitch 82 which senses a case in position between members 78 awaiting a synchronized release is light. Relay 704 is unenergized, and thus solenoid valve 402 is off. Accordingly, members 78 are in the withdrawn position and will allow a case to enter therebetween until the photoswitch 82 goes dark. While it is possible that this may occur at the desired synchronized time, in general this will not be true, and photoswitches 700, 86 and 84 will all be light. Accordingly, power is delivered through these three photoswitches through the lower set of switch contacts and through line 78 to the solenoid valve 402, thereby actuating the valve to close members 78 against the case to maintain it in that position. When a pair of cleats pass the cleat photoswitch 84, that switch momentarily goes dark. This actuates relay 702, which latches in the actuated position because of the connection of the upper set of switch contacts therein, thereby turning off solenoid 402 and releasing the case at that time. Of course, photoswitch 82 remains dark, and while the cleat photoswitch 84 will go light immediately after the cleat passes, it will again go dark very shortly thereafter, as the leading edge of the just released case starts past the photoswitch.

Photoswitch 86 is preferably located along the conveyor very slightly greater than one case length from the photoswitch 82. Accordingly, when switch 86 goes dark indicating the arrival of the leading edge of the case at that point solenoid 402 will again be turned on (providing switch 82 is still dark indicating a supply of cases) to stop the flow of cases until the next case is to be released. When switch 86 first goes dark, cleat photoswitch 84 will also be dark sensing not a cleat but the case itself. As the case continues, its trailing edge will soon pass the cleat switch 84, allowing that switch to go light. This signal from cleat switch 84 could be used to enable the release of the next case when cleat switch 84 again went dark upon the passage of a cleat. However, in the present embodiment a signal from photoswitch 700 is used to enable the release, which signal is actuated by the darkening of the photoswitch 700 by the leading edge of the case just after the trailing edge passes switch 84. Thus, just after the trailing edge of the case passes photoswitch 84 allowing it to go light, photoswitch 700 goes dark (photoswitch 86 already being dark). This enables the cleat photoswitch 84 (e.g. resets the system) causing the actuation of solenoid 402 upon the next passage of a pair of cleats past photoswitch 84 to release the next case. Accordingly, cases are individually synchronously released as required, so as to allow the cases to proceed initially along the conveyor, each located between two sets of cleats. Of course, after passage beyond the photoswitch 700, the cases are lifted slightly as hereinbefore described so as to be stopped until the set of cleats immediately therebehind catches up with the case and provides a positive (though yieldable) drive for the case under the uncasing head even in the presence of ski-like members to hold the case down against the lifting forces of the individual bottle grippers.

The above described embodiment for the circuitry and photoswitches to control the synchronization of the cases performs three important functions, among others. These are:

1. It provides a latch to release a case upon the momentary passage of the cleat past a predetermined position.

2. It provides a means for sensing the arrival of the next case between the members 78 for temporary retention at that point (which may not be sensed by the case position sense photoswitch 82 alone because that switch will be maintained permanently dark by a continuous flow of cases) and 3. It provides a means for resetting or enabling the cleat photoswitch 84 so as to allow the release of the next case the next time the cleat photoswitch 84 goes dark sensing the passage of a pair of cleats therebetween.

Of course, this last requirement could be eliminated by placing the cleat photoswitch 84 at an appropriate position below the case trajector such as approximately level with the axis of the forward chain sprockets and forward thereof so as to sense the passage of the cleats in their upward travel at that point. Of course, other modifications to the sensor location and the circuitry may also readily by made by one skilled in the art to achieve the desired result. Applicants have found, however, that photo sensors placed where they may readily be observed together with the relays provide an easily maintained, easily tested and highly reliable system, which may be manufactured at a relatively low cost. Also by using photoswitches having adjustable mounting, adjustment in the position thereof may be made so as to achieve preferred operating sequences with varying size cases.

There is described herein a reliable, high speed full depth uncaser with a variety of safety and other operational features, the frame and conveyor system of which may also receive an alternate type of uncasing head for uncasing half depth uncasers. Of course, for such operations, members 78 would be maintained in the withdrawn condition so that a continuous flow of cases could be delivered to the half depth uncaser, and reference blocks 66 would generally be removed (or folded downward) so as to not be operative. Thus, the full depth and half depth cases may be uncased at the same station and utilizing much common equipment.

There has been described herein the preferred embodiment of the present invention. It is to be noted, however, that alternate embodiments may be readily fabricated by one skilled in the art. By way of example, an embodiment could easily be fabricated wherein cases would be delivered to a larger uncasing head in a sidewise orientation so as to effectively increase the speed of the uncaser without any increase in the linear velocity of the transport means. Similarly, the transport means within the uncasing head could be provided with groups of grippers in two or more case patterns, with appropriate changes in the case sensing and operation of the case holding members 78, so that cases of either two or more types could be released in synchronism with the corresponding grippers, thereby allowing one uncasing head to uncase more than one type of full depth case. Of course, other features may also be provided, such as by way of example, the guard 550 normally disposed outward and above the cases to detect any obstruction in cases projecting above that level. Such a guard is pivoted at point 552 and is adapted to actuate a micro-switch 554 to turn off the machine, should an obstruction force the guard 550 upward. Similarly, portions of the cover 556, generally at each end for the transport means, are hinged for access to the transport means and may be provided with similar micro-switches which are to turn off the machine whenever the covers are tilted opened by an operator or by an obstruction in the transport means. Thus, while the preferred embodiment of the present invention has been disclosed herein, various changes in form and details may be made therein without departing from the spirit and scope of the invention.

I claim:

1. In a bottle handling apparatus, a bottle gripper comprising:

a support means;

first and second gripping members each pivotally supported by said support means, said gripping members being rotatable between a first position whereby the lower portion of said gripping members may engage a bottle neck and a second position not engaging a bottle neck;

spring means for encouraging said gripping members to said first position;

an actuator member moveable between third and fourth positions, said actuator extending upward so as to be engageable from above for encouragement from said third position to said fourth position;

over-center toggle means, said toggle means being coupled between said first and second gripping member and said actuator member, said toggle means being a means for allowing said first and second gripping members to be moved by said spring means toward said first position as said actuator member moves toward said third position, and for locking said actuator member at said fourth position and said first and second gripping members at said second position by the over-center action of said toggle means, whereby said first and second gripping members will snap to said first position and said actuator member to said third position as said actuator is encouraged to move from said fourth position;

means for yieldably supporting said support means so that the lower portion of said gripping members may be deflected from their normal positions upon contact with a bottle, the lower portion of said gripping members being chamfered to engage a bottle neck and encourage said gripper and said bottle neck into approximate axial alignment.

2. The bottle gripper of claim 1 wherein said first and second gripping members are disposed in a generally vertical disposition and are pivotally supported adjacent the upper end thereof, and said first position is a position whereby the lower ends of said gripping members are encouraged into closer proximity to be closeable around the neck of a bottle.

3. The bottle gripper of claim 2 wherein said actuator member is an elongate, generally vertically disposed member extending downward between said first and second gripping members, said actuator member being moveable in a vertical direction between an upper said third position and a lower said fourth position, said actuator member being a means for contacting the top of a bottle to cause said first and second gripping members to close around said bottle.

4. In a bottle handling apparatus, a bottle gripper comprising: a generally elongate, vertically disposed hollow support means;

first and second gripping members, each having first and second ends, each of said gripping members being rotationally coupled to said support means on first and second substantially parallel, horizontally disposed spaced apart first axes, adjacent said first ends thereof, said gripping members being means for engaging and encouraging said bottle necks into axial alignment with said support means when said second ends are encouraged into close disposition;

a coil spring coupled between said first and second gripping members so as to encourage said members into closer proximity;

an actuator member slidable between lower first and higher second actuator positions within said support means and between said first and second gripping members so as to be engagable with the top of a bottle and said first actuator position is vertically below said second actuator position, said actuator member being generally disposed within said support means and between said first and second gripping members and extending upward through said support means to be engagable from above for encouragement from said second position toward said first position;

first and second coupling members, said first and second coupling members being rotationally coupled adjacent the ends thereof, on second axes substantially parallel to said first axes; to said actuator member and said first and second gripping members respectively, said coupling members being substantially horizontal when said actuator member is adjacent said first actuator position;

said gripper further comprising coil springs, retaining means, a transport means and a mounting means, said transport means being a means for supporting and moving said mounting means along a predetermined path, said mounting means having a hole therethrough for each of said grippers a predetermined amount larger than the cross-section of said support means, said support means of each said gripper extending upward through one of said holes, said retaining means being a means for slideably retaining said support means with respect to said mounting means to prevent said support means from being encouraged downward out of said holes, each of said coil springs being disposed in compression over one of said support means between said mounting means and the lower portion of said support means to yieldably encourage each of said grippers in a downward direction.

5. The gripper of claim 4 wherein the lower ends of said gripping members have a substantial chamfer so as to be engagable with a bottle top to encourage said bottle top and said gripper into relative disposition with said bottle top disposed between said gripping members.

6. The grippers of claim 5 wherein the facingly disposed lower portions of said gripping members have rubber inserts thereon so that said rubber inserts are engageable with said bottle neck when said gripping members are in said first position.

7. In a bottle handling apparatus, a bottle gripper comprising:

a support means for coupling of said bottle gripper to said bottle handling apparatus;

a pair of gripping members having a generally split cylindrical shape, said pair defining a first axial cavity within said split cylindrical shape, for accommodating a bottle neck, said gripping members being rotationally coupled to said support means at one end of said gripping members;

a spring coupled between said pair of gripping members so as to encourage said members into closer proximity;

an on-center actuator member, axially disposed within said first cavity and a second cavity centrally defined within said support means, said actuator member being a single rigid rod slideable within said first and second cavity and extending within said first cavity to be engageable with the top of a bottle accommodated therein; and a pair of over-center toggle members rotationally coupled to said gripping members and said actuator member, whereby movement of said actuator member to a first position rotates said toggle members to third position locking and spreading said gripping members into an open position against the tension of said spring, and whereby movement of said actuator member to a second position rotates said toggle members to a fourth position allowing said spring to close said gripping members;

wherein said support means comprises a base member coupled to said gripping members and retaining said actuator member within said second cavity;

a mounting member coupled to said base member, said mounting member defining an opening therein, said base member loosely and slideably disposed and retained in said opening;

a coil spring disposed about said base member and compressible between said base and mounting members; and a transport means for translating said mounting member and gripper along a predetermined path, whereby said grippers are resiliently and slideably coupled to said mounting member and are translated in a controlled manner by said transport means.

8. The bottle gripper of claim 7 wherein:

said spring is a single on-center spring coupled between said gripping members; and said gripping members have a chamfer on that portion distal from said support means, whereby said gripping members are substantially aided in efficiently engaging a bottle neck in a disordered array of bottles.

9. In a bottle handling apparatus, a bottle gripper comprising:

a support means having a generally elongate, vertically disposed support member having a longitudinal opening therein;

first and second gripping members disposed in a generally vertical disposition and are pivotally supported adjacent the upper end thereof by said support means, said gripping members being rotatable between a first position whereby the lower ends of said gripping members are encouraged into closer proximity to be closeable around the neck of a bottle neck and a second position not engaging a bottle neck, said gripping members having first and second ends, each of said gripping members being rotationally coupled to said support means on first and second substantially parallel, horizontally disposed spaced apart first axes, adjacent said first ends thereof, said gripping members being means for engaging and encouraging said bottle neck into axial alignment with said support means when said second ends are encouraged into close disposition;

spring means for encouraging said gripping members to said first position;

an elongate, generally vertically disposed actuator member extending downward between said first and second gripping members, said actuator member being moveable in a vertical direction between an upper said third position and a lower said fourth position, said actuator member being a means for contacting the top of a bottle to cause said first and second gripping members to close around said bottle, said actuator member being generally disposed within said longitudinal opening and extending above said support means so as to be forceable into said fourth position by engagement from above with a depression means; and over-center toggle means, said toggle means being coupled between said first and second gripping member and said actuator member, said toggle means being a means for allowing said first and second gripping members to be moved by said spring means toward said first position as said actuator member moves toward said third position, and for locking said actuator member at said fourth position and said first and second gripping members at said second position by the over-center action of said toggle means, whereby said first and second gripping members will snap to said first position and said actuator member to said third position as said actuator is encouraged to move from said fourth position.

10. A plurality of bottle grippers of claim 9 further comprised of coil springs, retaining means, a transport means and a mounting means, said transport means being a means for supporting and moving said mounting means along a predetermined path, said mounting means having a hole therethrough for each of said grippers a predetermined amount larger than the cross-section of said support means, said support means of each said gripper extending upward through one of said holes, said retaining means being a means for slideably retaining said support means with respect to said mounting means to prevent said support means from being encouraged downward out of said holes, each of said coil springs being disposed in compression over one of said support means between said mounting means and the lower portion of said support means to yieldably encourage each of said grippers in a downward direction.

11. The grippers of claim 10 wherein, for each of said grippers, the lower ends of said gripping members have a substantial chamfer so as to be engageable with a bottle top to encourage said bottle top and the respective one of said grippers into relative disposition with said bottle top disposed between said gripping members.

12. The grippers of claim 11 wherein the facingly disposed lower portions of said gripping members have rubber inserts thereon so that said rubber inserts are engageable with said bottle neck when said gripping members are in said first position.

* * * * *